US007623820B2

(12) United States Patent
Nada et al.

(10) Patent No.: US 7,623,820 B2
(45) Date of Patent: Nov. 24, 2009

(54) IMAGE FORMING APPARATUS WITH RESIDUAL TONER CONVEYANCE FEATURE FOR IMPROVED DETECTION/COLLECTION OF ACCUMULATED RESIDUAL TONER

(75) Inventors: Takao Nada, Numazu (JP); Hiroyuki Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 11/675,326

(22) Filed: Feb. 15, 2007

(65) Prior Publication Data

US 2007/0196147 A1 Aug. 23, 2007

(30) Foreign Application Priority Data

Feb. 22, 2006 (JP) ..... 2006-044699

(51) Int. Cl.
*G03G 21/10* (2006.01)

(52) U.S. Cl. ..... 399/358

(58) Field of Classification Search ..... 399/35, 399/120, 358, 360

See application file for complete search history.

(56) References Cited

U.S. PATENT DOCUMENTS

| | | | | |
|---|---|---|---|---|
| 5,890,034 | A | 3/1999 | Hiroshi et al. | 399/106 |
| 6,298,217 | B1 | 10/2001 | Murayama et al. | 399/358 |
| 2006/0039710 | A1 | 2/2006 | Tawada | 399/35 |

FOREIGN PATENT DOCUMENTS

| | | | |
|---|---|---|---|
| EP | 0 833 225 | A1 | 4/1998 |
| EP | 1 065 575 | A2 | 1/2001 |
| JP | 01-97980 | A | 4/1989 |
| JP | 5-165331 | | 7/1993 |
| JP | 5-173457 | | 7/1993 |
| JP | 2000-132033 | | 5/2000 |
| JP | 2000-330440 | | 11/2000 |
| JP | 2001-222168 | | 8/2001 |
| JP | 2001-356619 | | 12/2001 |

(Continued)

OTHER PUBLICATIONS

Korean Office Action mailed Mar. 17, 2008 in Application No. 10-2007-0017347, with English-language translation.

(Continued)

*Primary Examiner*—David M Gray
*Assistant Examiner*—Andrew V Do
(74) *Attorney, Agent, or Firm*—Fitzpatrick, Cella, Harper & Scinto

(57) ABSTRACT

An image forming unit includes an image bearing member. A transfer member transfers a toner image on the image bearing member to a record member. A cleaning member cleans toner adhered onto the transfer member. A toner container contains toner cleaned by the cleaning member. A toner sensor, which is positioned at a center area of said toner container in a direction orthogonal to a moving direction of the image bearing member and detects an amount of collected toner. A conveyance member conveys the collected toner and includes first screws to convey toner to a position corresponding to an area in which the first area is excluded from the second area in a direction toward the detection position, and second screws to convey toner to a position between said first screws and the detection position in a direction opposite to the direction toward the detection position.

2 Claims, 14 Drawing Sheets

FOREIGN PATENT DOCUMENTS

| | | | |
|---|---|---|---|
| JP | 2002-148884 | | 5/2002 |
| JP | 2003-015493 | A | 1/2003 |
| JP | 2004-045451 | | 2/2004 |
| JP | 2004-341051 | A | 12/2004 |
| JP | 2004-354524 | | 12/2004 |
| JP | 2005-352402 | | 12/2005 |
| KR | 1998-025160 | | 7/1998 |

OTHER PUBLICATIONS

Japanese Office Action mailed Mar. 27, 2008 in Application No. 2006-044699, with English-language translation.

IMAGE FORMING APPARATUS WITH RESIDUAL TONER CONVEYANCE FEATURE FOR IMPROVED DETECTION/COLLECTION OF ACCUMULATED RESIDUAL TONER

BACKGROUND OF THE INVENTION

1. Field of the Invention

The present invention relates to an image forming apparatus having a collecting container which contains the toner collected from an image bearing member.

2. Description of the Related Art

There is a cleaning unit as a conventional technique for cleaning the toner on an image bearing member of an image forming apparatus. The image forming apparatus disclosed in the Japanese Patent Application Laid-Open No. H05-173457 has a brush roller for collecting the toner on a photosensitive drum, and the toner collected by the brush roller is pushed into a cleaning unit. The photosensitive drum and the cleaning unit are arranged side by side. If there is a biased amount of toner on the photosensitive drum in the longitudinal direction, the toner is pushed into the cleaning unit with the bias. If a large biased amount of toner is collected at a position apart from a toner detection unit in the cleaning unit, then the problem that the toner flows from the position where the large biased amount of toner has been collected before the full toner is detected is recognized. To solve this problem, Japanese Patent Application Laid-Open No. H05-173457 describes that the toner in the cleaning container is collected by moving the toner immediately below the toner detection unit.

However, there can be a result of detecting a large amount of collected toner although there is a small amount of toner in the cleaning unit when the toner is automatically conveyed to the detection unit of, for example, the image forming apparatus disclosed in Japanese Patent Application Laid-Open No. H05-173457.

The present invention has been developed to solve the foregoing problem.

There is also Japanese Patent Application Laid-Open No. 2002-148884 having the configuration of conveying toner in a cleaning unit, but the application does not originally have the problem from biased toner in the longitudinal direction of an image bearing member.

SUMMARY OF THE INVENTION

A purpose of the present invention is to correctly grasp the amount of toner in a collecting container or to improve the toner containing efficiency of a toner collecting container.

Another purpose of the present invention is to provide an image forming apparatus including: a toner bearing member which bears toner, the toner bearing member being movable in a moving direction; a toner container which contains toner collected from the toner bearing member; a conveyance member for conveying the toner in the toner container; and a toner sensor for detecting the toner at a deteet detection position in the toner container. In a direction orthogonal to the moving direction of the toner bearing member, the conveyance member conveys the toner in a direction of leaving the detection position.

A further purpose of the present invention is to provide an image forming apparatus including: a toner bearing member which bears toner, the toner bearing member being movable in a moving direction; a toner container which contains toner collected from the toner bearing member; a conveyance member for conveying the toner in the toner container; a toner sensor for detecting the toner at a detection position in the toner container; a first area in the toner container; and a second area in the toner container closer to the detection position than the first area in a direction orthogonal to the moving direction of the toner bearing member. In the first area, the conveyance member conveys the toner toward the detection position, and the movement of the toner toward the detection position is suppressed in the second area.

A further purpose of the present invention is to provide an image forming apparatus including: a toner bearing member which bears toner, the toner bearing member being movable in a moving direction; a toner container which contains toner collected from the toner bearing member; a toner sensor for detecting the toner at a detection position in the toner container; a first area in the toner container; and a second area in the toner container closer to the detection position than the first area. In the first area, the toner is conveyed toward the detection position. In the second area, the movement of the toner toward the detection position is suppressed. The detection position is in an area in which the toner bearing member bears the toner in the direction orthogonal to the moving direction of the toner bearing member.

A further purpose of the present invention is to provide an image forming apparatus including: an image bearing member for bearing a toner image; a transfer member for transferring the toner image on the image bearing member; a toner container which contains toner collected from the toner bearing member; a toner sensor for detecting the toner at a detection position in the toner container; a first area in the toner container; and a second area in the toner container closer to the detection position than the first area. The transfer member transfers only an area of a part of a toner image on the image bearing member to a record member. In the first area, the toner is conveyed toward the detection position. In the second area, the conveyance of the toner toward the detection position is suppressed.

A further purpose of the present invention is to provide an image forming apparatus including: a toner bearing member which bears toner in a moving direction; a transfer member for transferring a toner image on the image bearing member; a collecting member for collecting remaining toner on the image bearing member; a toner container which contains toner collected by the collecting member; and a conveyance member for conveying the toner in the toner container. In the direction orthogonal to the moving direction of the image bearing member, the transfer member transfers a toner image to a record member except an end portion area of the toner image, and the conveyance member conveys the toner toward the center of the toner container.

A further purpose of the present invention is to provide an image forming apparatus including: a toner bearing member which bears toner in a moving direction; a toner container which contains toner collected from the toner bearing member; a toner sensor for detecting the toner at a detection position in the toner container; a first area in the toner container; and a second area in the toner container closer to the detection position than the first area in a direction orthogonal to the moving direction of the toner bearing member. In the first area, the toner is conveyed toward the detection position. In the second area, the toner is conveyed in a direction of leaving the detection position.

A still further purpose of the present invention will be more clearly described with reference to the following descriptions and the attached drawings.

DESCRIPTION OF THE EMBODIMENTS

The exemplary embodiments of the present invention are described below in detail with reference to the attached drawings. The dimensions, materials, shapes, the relative arrangements, etc. of the components described in the following embodiments of the present invention are to be appropriately changed depending on the configurations of the devices to which the present invention is applied and various conditions. Therefore, the scope of the present invention is not limited to the modes described below.

Embodiment 1 of the Present Invention

In the descriptions below, a rough configuration of the image forming apparatus is first described by referring to FIG. 1, and then the cleaning device according to the embodiment 1 of the present invention is described by referring to FIGS. 2 to 7.

[General Description of the Image Forming Apparatus]

Figure 1:
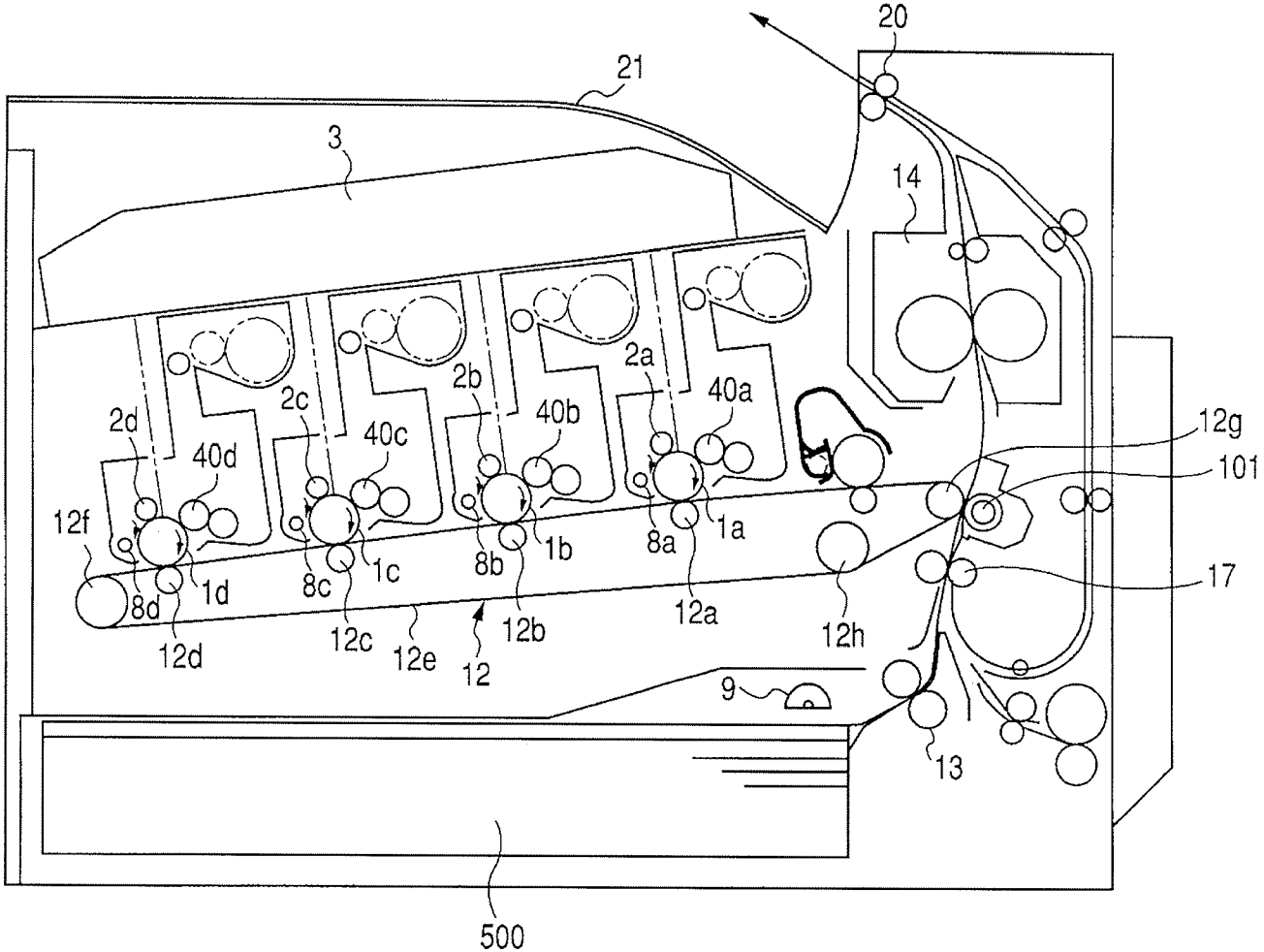
FIG. 1 is a schematic chart illustrating a rough configuration of the electronic photo image forming apparatus according to an embodiment 1 of the present invention.

FIG. 1 is a schematic chart illustrating the overall configuration of the electronic photo image forming apparatus according to a mode for embodying the present invention.

In the present embodiment, the device includes four electronic photosensitive drums 1*a*, 1*b*, 1*c* and 1*d* (hereinafter referred to simply as "photosensitive drums 1") for yellow, magenta, cyan and black as the image bearing members mounted at an angle as shown in FIG. 1. In the positions opposite the photosensitive drums 1 as the image bearing members, an intermediate transferring belt 12*e*, which is an intermediate transfer member for a primary transfer of a toner image formed on the surface of the photosensitive drum 1, is mounted through a drive roller 12*g*, a tension roller 12*f* and a driven roller 12*h*. A secondary transfer unit 101 is arranged in the position opposite the drive roller 12*g* through the intermediate transferring belt 12*e*.

A toner image formed on each photosensitive drum 1 is transferred to the intermediate transferring belt 12*e* by the effect of primary transfer units 12*a*, 12*b*, 12*c* and 12*d*. Around the photosensitive drum 1, primary charge devices 2*a*, 2*b*, 2*c* and 2*d* (hereinafter referred to simply as "primary charge devices 2"), developing units 40*a*, 40*b*, 40*c* and 40*d* (hereinafter referred to simply as "developing units 40", and cleaning units 8*a*, 8*b*, 8*c* and 8*d* (hereinafter referred to simply as "cleaning units 8") are arranged in order from the upstream in the rotation direction.

The primary charge device 2 is a charge unit for evenly charging the surface of the photosensitive drum 1. A electrostatic latent image is formed on the surface of the photosensitive drum 1, which is evenly charged by the primary charge device 2 after an exposing unit 3 irradiates the surface with a laser beam according to image information. The developing unit 40 develops a toner image by attaching the toner (developing agent) of each color on the surface of the photosensitive drum 1 on which the electrostatic latent image is formed. The cleaning unit 8 removes the remaining toner on the surface of the photosensitive drum 1 after the transfer.

On the other hand, a record member 500 supplied from a pickup roller 9 out of a feed cassette is separately fed piece by piece from a separating unit not shown in the attached drawings. Then, the member is transmitted by a convey roller pair 13 to a registration roller pair 17, and is conveyed by the registration roller pair 17 to the space between the intermediate transferring belt 12*e* and a secondary transfer unit 101 with predetermined timing. The secondary transfer unit 101 performs a secondary transfer to a record member 500 on the toner image primarily transferred to the intermediate transferring belt 12*e*.

The record member 500, to which the toner image has been transferred, has the toner image fixed by a fixing unit 14, is conveyed by an eject roller pair 20, and is ejected on an eject tray 21 mounted on the upper portion of the body of the device.

[Description of the Arrangement of the Residual Toner Conveyance Unit]

The configurations of the secondary transfer unit and the cleaning device according to the present embodiment are described by referring to FIGS. 2 to 5A and 5B.

In these figures, the secondary transfer roller 101 as a rotation member as a secondary transfer unit is illustrated. A cleaning device 100 for removing and storing the toner (developing agent) attached to the surface of the secondary transfer roller 101 is mounted. The cleaning device 100 has a cleaning blade 111 as a cleaning member which contacts the surface of the secondary transfer roller 101 and removes the toner attached to the surface of the secondary transfer roller 101. The cleaning device 100 also has a residual toner container 150 as a collecting container for containing the toner removed from the secondary transfer roller 101. Furthermore, the cleaning device 100 has a residual toner detection device 350 as a toner detection unit for detecting the toner in the residual toner container 150. The residual toner detection device 350 is located at the center in the axis direction of the secondary transfer roller 101. The cleaning device 100 has a residual toner conveyance unit 200 as a toner conveyance unit for conveying toner in the residual toner container 150.

Figure 2:
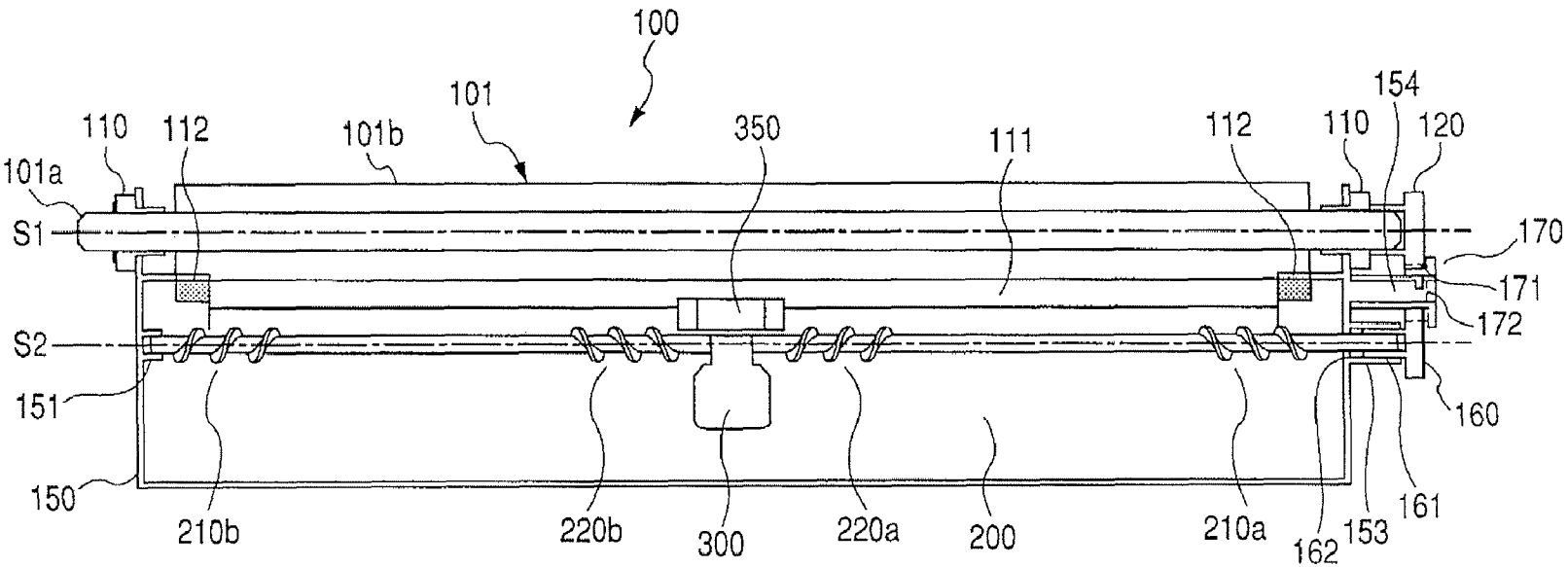
FIG. 2 is a sectional view illustrating the configuration of the cleaning device according to the embodiment 1 of the present invention.

As shown in FIG. 2, the secondary transfer roller 101 is configured by a secondary transfer roller unit 101*b* and a secondary transfer roller metal core 101*a*, and positioned on the residual toner container 150 through a bearing 110. A secondary transfer roller drive gear 120 is mounted at one end of the secondary transfer roller 101, and is designed to rotate with the secondary transfer roller 101.

The residual toner container 150 is provided with the cleaning blade 111, and is configured to correctly contact the secondary transfer roller 101 at a predetermined position. A first seal member 112 is mounted at both ends of the cleaning blade 111 so that residual toner cannot leak from the end portions. A sweeper strip 113 (refer to FIG. 3) is provided upstream the cleaning blade 111 so that the upstream residual toner can be prevented from leaking out.

The residual toner conveyance unit 200 is arranged such that an axis S1 of the secondary transfer roller 101 can be substantially parallel with the axis S2 of the residual toner conveyance unit 200. The residual toner conveyance unit 200 is arranged below the position where the cleaning blade 111 contacts the secondary transfer roller 101 at the upper portion of the residual toner container 150 (refer to FIG. 3).

As shown in FIG. 2, one end of the residual toner conveyance unit 200 is engaged in a first bearing unit 151 provided in the residual toner container 150. Residual toner conveyance unit drive gear 160 configured to rotate with the residual toner conveyance unit 200 is mounted on the other end of the unit. By a cylindrical unit 161 of the residual toner conveyance unit drive gear 160 being engaged in a second bearing unit 153, the position of the residual toner conveyance unit 200 relative to the residual toner container 150 can be determined.

A second seal member 162 is arranged between the residual toner container 150 and the residual toner conveyance unit drive gear 160. With the configuration, the residual toner can be prevented from leaking out from the engagement portion between the residual toner conveyance unit 200 and the residual toner container 150.

Figure 4:
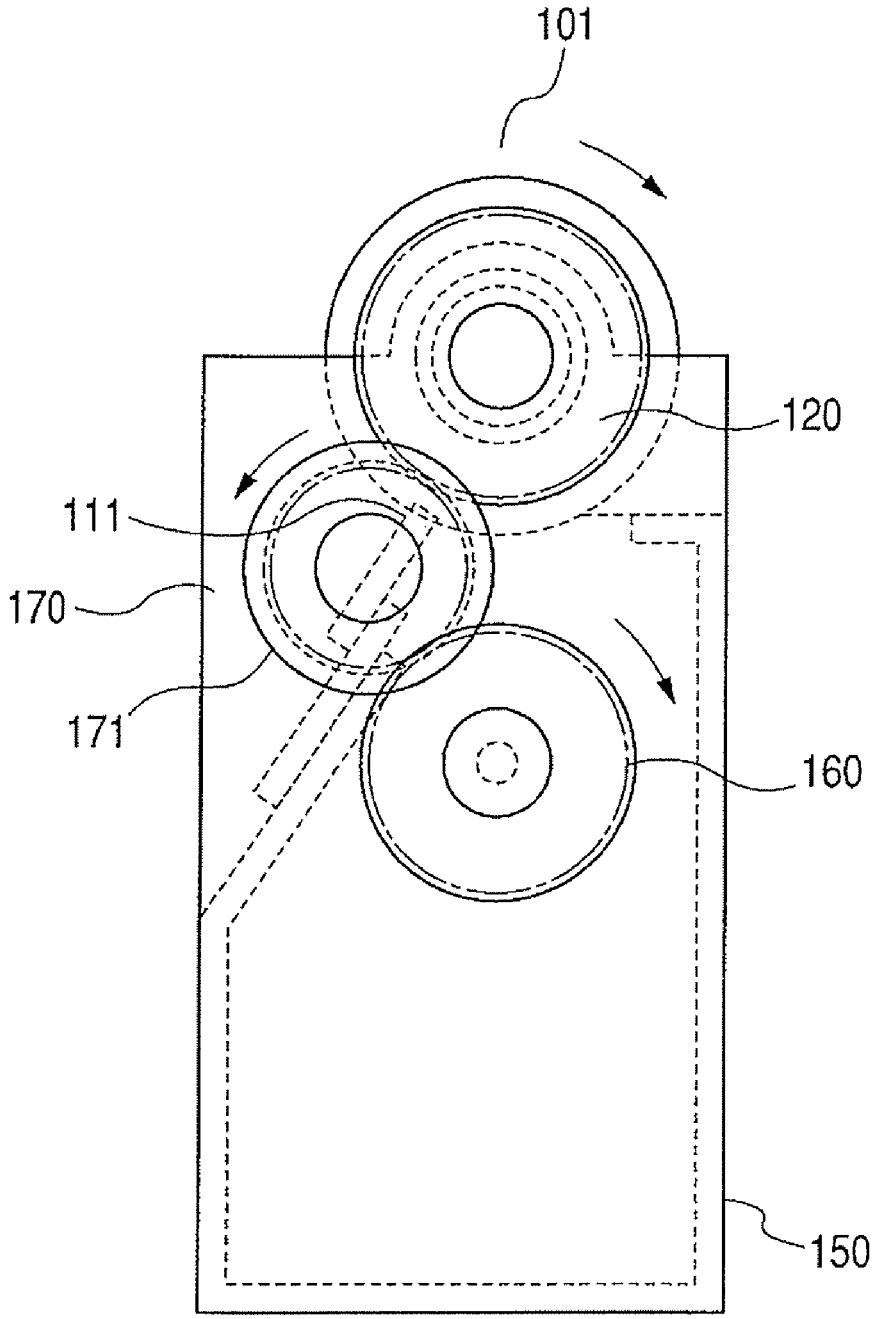
FIG. 4 is a side view illustrating the drive transmission to the cleaning device according to the embodiment 1 of the present invention.

An intermediate gear 170 is arranged so as to engage with an intermediate gear axis 154, and transmits the drive force from the secondary transfer roller drive gear 120 to the residual toner conveyance unit drive gear 160 as shown in FIG. 4. Using a claw 172, the intermediate gear 170 is designed not to slip down. Furthermore, the intermediate gear flange 171 is provided in the intermediate gear 170. The intermediate gear flange 171 is engaged with the secondary transfer roller drive gear 120 and the residual toner conveyance unit drive gear 160 to prevent them from slipping down.

The residual toner conveyance unit 200 has first screws 210*a* and 210*b* as first convey units for conveying toner in the direction of the axis of the secondary transfer roller 101 from both ends toward the center in the residual toner container 150. Additionally, the residual toner conveyance unit has second screws 220*a* and 220*b* as second convey units for conveying toner in the direction of the axis of the secondary transfer roller 101 from the center toward both ends of the secondary transfer roller 101.

Figure 3:
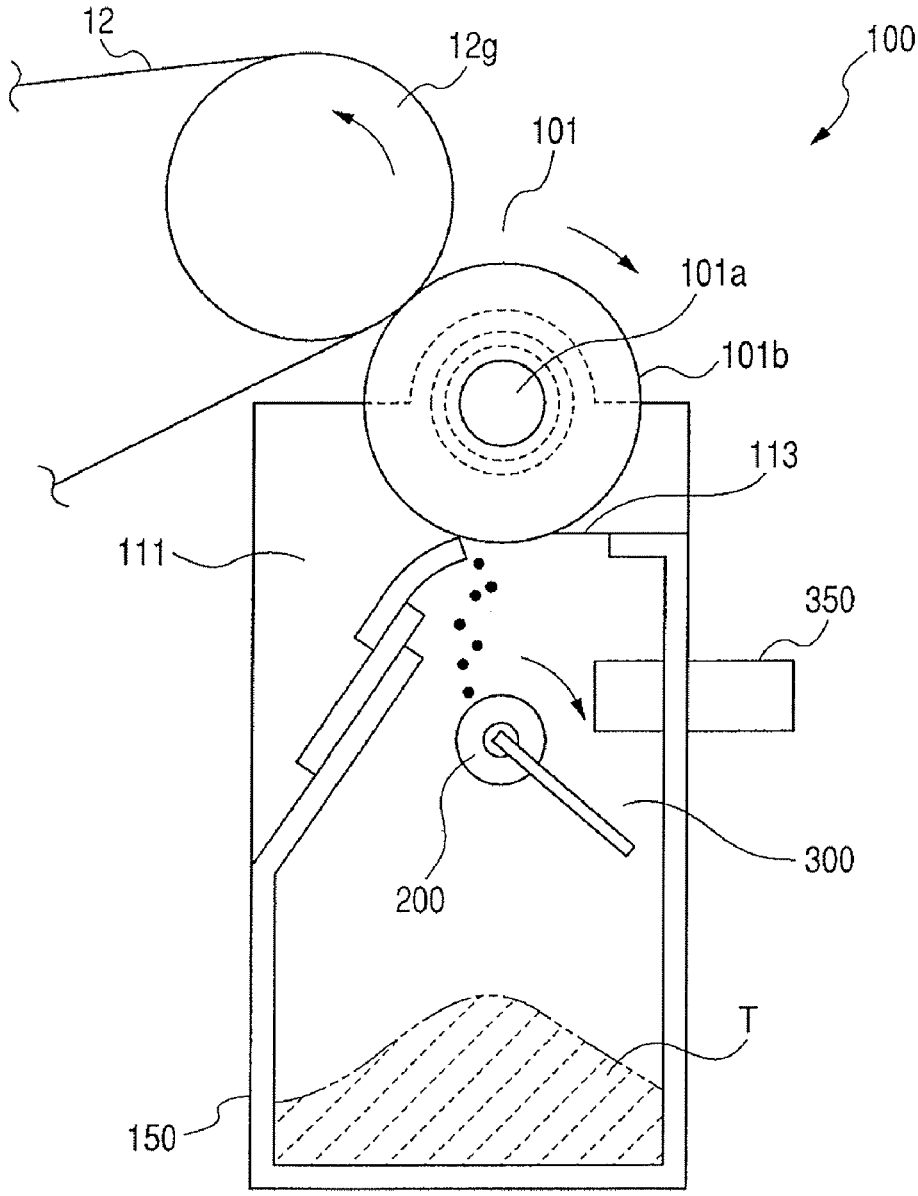
FIG. 3 is a primary sectional view illustrating the arrangement of the cleaning device according to the embodiment 1 of the present invention.

In the residual toner conveyance unit 200, the first screws 210*a* and 210*b* are formed with the inverse spiral directions from the both ends toward the center in the axis direction of the secondary transfer roller 101. The second screws 220*a* and 220*b* are formed with the inverse spiral directions from the center toward both ends in the axis direction of the secondary transfer roller 101. By the residual toner conveyance unit 200 rotating and driving clockwise as shown in FIG. 3, the first screws 210*a* and 210*b* generate the conveying force toward the center of the residual toner conveyance unit 200. Similarly, by the residual toner conveyance unit 200 rotating and driving clockwise as shown in FIG. 3, the second screws 220*a* and 220*b* generate the conveying force toward both ends of the residual toner conveyance unit 200. Although the screws are formed in the above-mentioned spiral shape in the present embodiment, the directions of the spirals are inverse in the configuration in which the rotation of the residual toner conveyance unit 200 shown in FIG. 3 is set counterclockwise.

The residual toner conveyance unit 200 is not provided with a screw (convey unit) formed in the spiral direction between the first screw 210*a* and the second screw 210*a* and between the first screw 210*b* and the second screw 220*b*.

The first screws 210*a* and 210*b* are arranged from outside to inside of the maximum print area of the image forming apparatus. To be more specific, the first screws 210*a* and 210*b* are mounted from outside to inside of the contact area of the cleaning blade 111 in contact with the secondary transfer roller 101 in the axis direction of the secondary transfer roller 101. Thus, the residual toner T that can be accumulated on both end portions of the residual toner container 150 can be correctly conveyed toward the center.

Figure 5A:
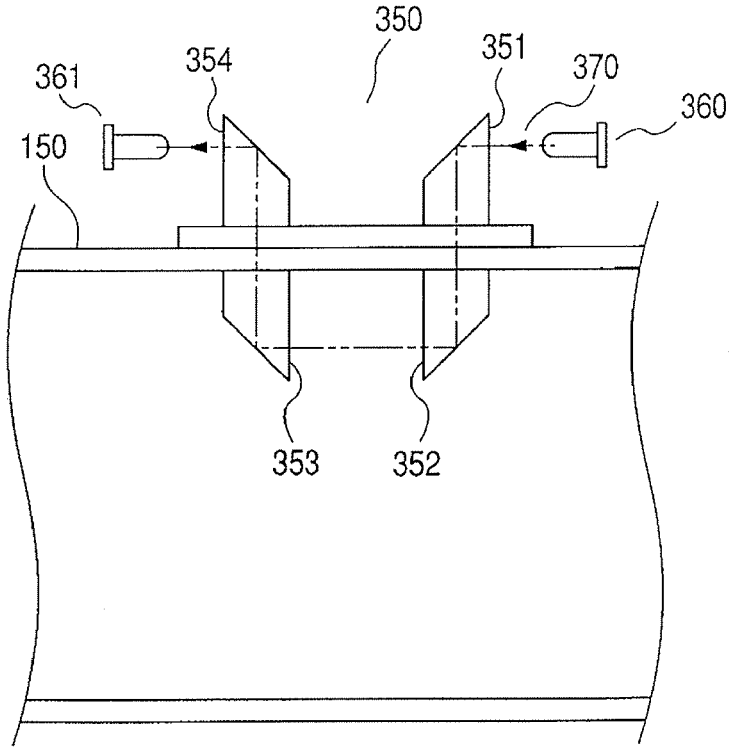
FIGS. 5A and 5B are partial sectional views illustrating the residual toner detection device according to the embodiment 1 of the present invention.
Figure 5B:
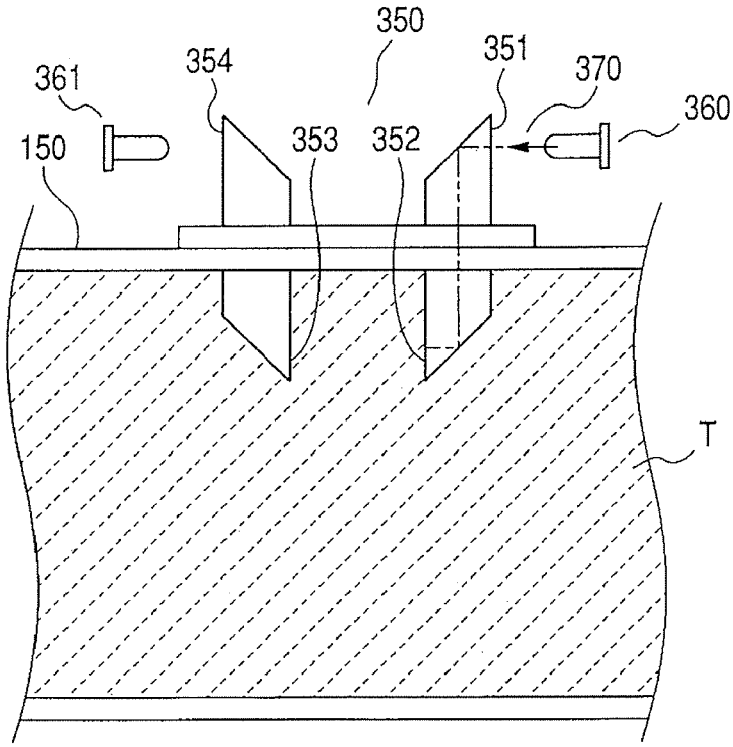

To detect the accumulation level of the residual toner T to the residual toner container 150, the residual toner detection device 350 is provided at the central portion of the residual toner container 150. The residual toner detection device 350 is a light guide of a transparent member, and is fixed to the residual toner container 150. FIGS. 5A and 5B illustrate the state of the residual toner container 150 seen from above.

As shown in FIGS. 5A and 5B, the residual toner detection device 350 has a first plane of irradiation 352 as a first detection plane for irradiation of infrared light 370 as detection light, and a second plane of incidence 353 as second detection plane for the incidence of the infrared light 370. The first plane of irradiation 352 faces the second plane of incidence 353 with the space into which toner can enter the residual toner container 150. In the space, the presence/absence of toner can be detected depending on whether or not the infrared light 370 between the two detection planes 352 and 353 can be cut off.

That is, if the residual toner T contained in the residual toner container 150 has not been accumulated to reach the residual toner detection device 350 as shown in FIG. 5A, the infrared light 370 emitted by an LED (light emitting device) 360 enters from a first plane of incidence 351, is irradiated from the first plane of irradiation 352, enters from the second plane of incidence 353, is irradiated by a second plane of irradiation 354, received by a photosensor (photoreceiver) 361, and is detected. Thus, the residual toner T can be detected in the residual toner container 150.

The two detection planes 352 and 353 of the residual toner detection device 350 are formed to perpendicularly cross the optical axis of the infrared light 370. The two detection planes 352 and 353 in the residual toner detection device 350 are inserted as entering the upper wall in the residual toner container 150. Thus, the residual toner can be removed from the two detection planes 352 and 353 by a cleaning member 300 without leaving the residual toner in the concave portion of the residual toner detection device 350.

Furthermore, the residual toner T removed from the secondary transfer roller 101 is constantly scattered in the residual toner container 150. By the attachment of the scattered residual toner T to the residual toner detection device 350, there is the possibility of a decreasing amount or cutoff of received light in the photosensor 361. To prevent this, the cleaning member 300 (refer to FIG. 2) for cleaning the first plane of irradiation 352 and the second plane of incidence 353 is provided. By the cleaning member 300 cleaning the first plane of irradiation 352 and the second plane of incidence 353, the decrease of the amount of received light or the cutoff of the light can be prevented in the photosensor.

As shown in FIGS. 2 and 3, the cleaning member 300 is configured to rotate with the residual toner conveyance unit 200. To be more specific, the cleaning member 300 is provided at the center in the axis direction of the residual toner conveyance unit 200 so that the cleaning member 300 can face the residual toner detection device 350. The cleaning member 300 is made of an elastic member such as urethane and the like, and passes between the first plane of irradiation 352 and the second plane of incidence 353 by contacting the respective surfaces. Thus, the residual toner T attached to the first plane of irradiation 352 and the second plane of incidence 353 is removed, thereby preventing the decrease of the amount of received light or the cutoff of the light by the scattered residual toner T in the photosensor 361.

If there is sufficient residual toner T accumulated in the residual toner container 150, the toner exceeds the cleaning capability of the cleaning member 300, and the detected light from the first plane of irradiation 352 to the second plane of incidence 353 is cut off by the residual toner T. If there is sufficient residual toner T accumulated in the residual toner container 150, then the cleaning member 300 rotates in the residual toner T, and slides on the surfaces of the first plane of irradiation 352 and the second plane of incidence 353. However, the toner is filled immediately after the cleaning member 300 passes. That is, as shown in FIG. 5B, the infrared light 370 emitted from the LED 360 enters the first plane of incidence 351 of the residual toner detection device 350, is irradiated on the first plane of irradiation 352, and then is cut off by the residual toner T. Therefore, the photosensor 361 does not receive the light, thereby determining that the residual toner container 150 is full of the residual toner T.

[Description of Frameless Print]

The frameless print obtained by forming an image over the entire record member 500 is described below by referring to FIG. 6.

The image forming apparatus according to the present embodiment can be operated in a normal print mode (first mode) and a frameless print mode (second mode). The normal print mode (also referred to as a "normal mode") refers to a mode in which a margin is formed on the entire perimeter of a record member. A frameless print mode refers to a mode in which no margin is formed on any perimeter of a record member. The frameless print also refers to a print on which no margin is formed on any perimeter of a record member.

In the frameless print mode, a toner image is formed in a broader range than the record member 500 on the intermediate transferring belt 12*e*. By transferring the toner image to the record member 500 by the secondary transfer roller 101, a frameless record can be made on the record member 500. If a large image formed on the intermediate transferring belt 12*e* is superposed on the record member, a toner image larger than the record member is generated. Since the toner image larger than the record member is not transferred to the record member, the image is directly transferred to the secondary transfer roller 101. That is, in the frameless print mode, a toner image excluding a part of the toner image on the intermediate transferring belt 12*e* is transferred to a record member. Thus, the toner image can be transferred to the end of the record member.

Figure 6:
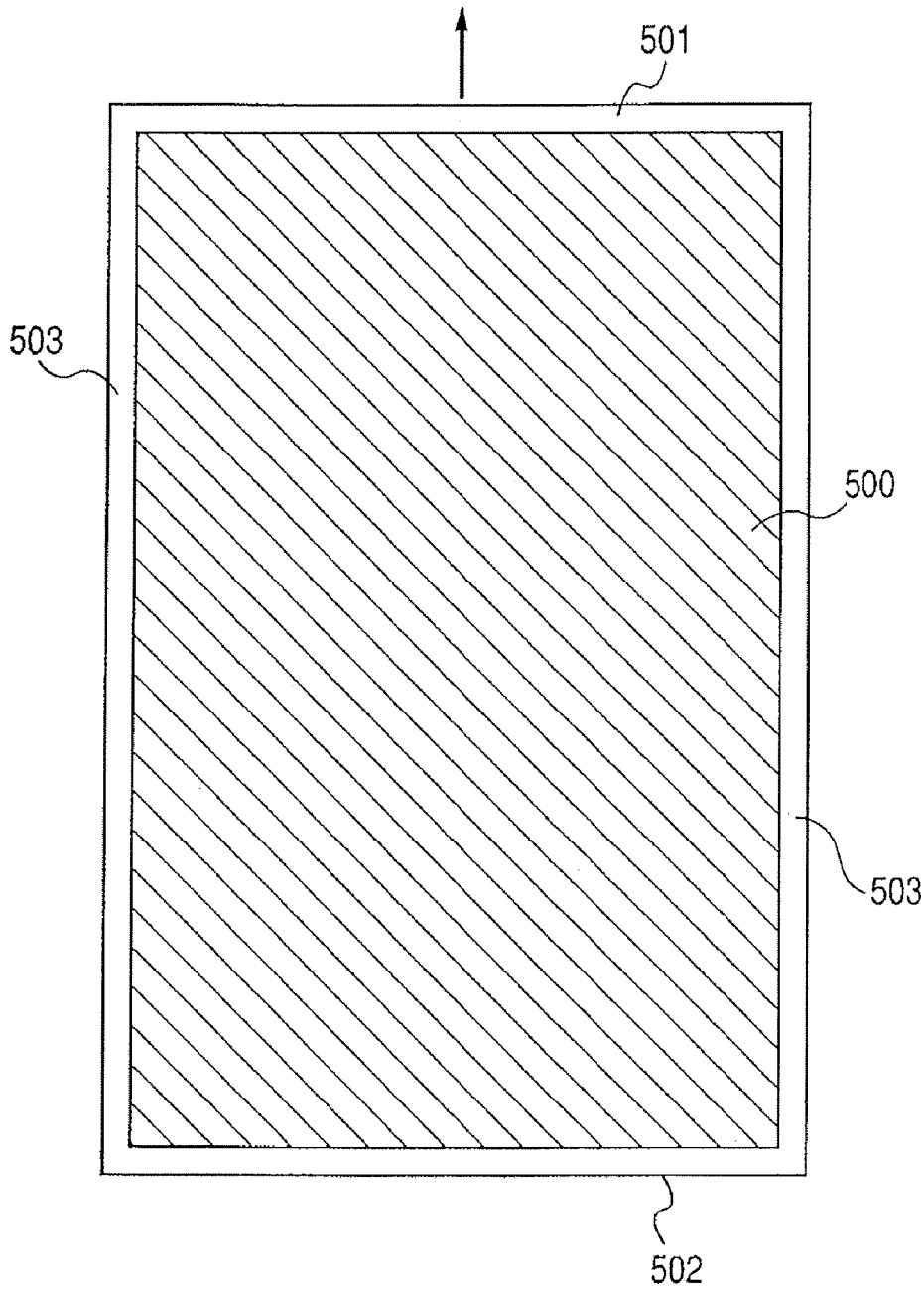
FIG. 6 is an explanatory view of a frameless print according to the embodiment 1 of the present invention.

When the process is described by referring to FIG. 6, a tip toner image 501 at the tip in the convey direction of the record member 500 indicated by an arrow mark, a back end toner image 502 at the back end in the convey direction, and a both end toner image 503 at both ends of the record member 500 are transferred to the secondary transfer roller 101 without being transferred to the record member 500. The toner on the secondary transfer roller 101 is removed by the cleaning blade 111 and stored in the residual toner container 150.

[Description of the Effect of the Residual Toner Conveyance Unit]

Figure 7:
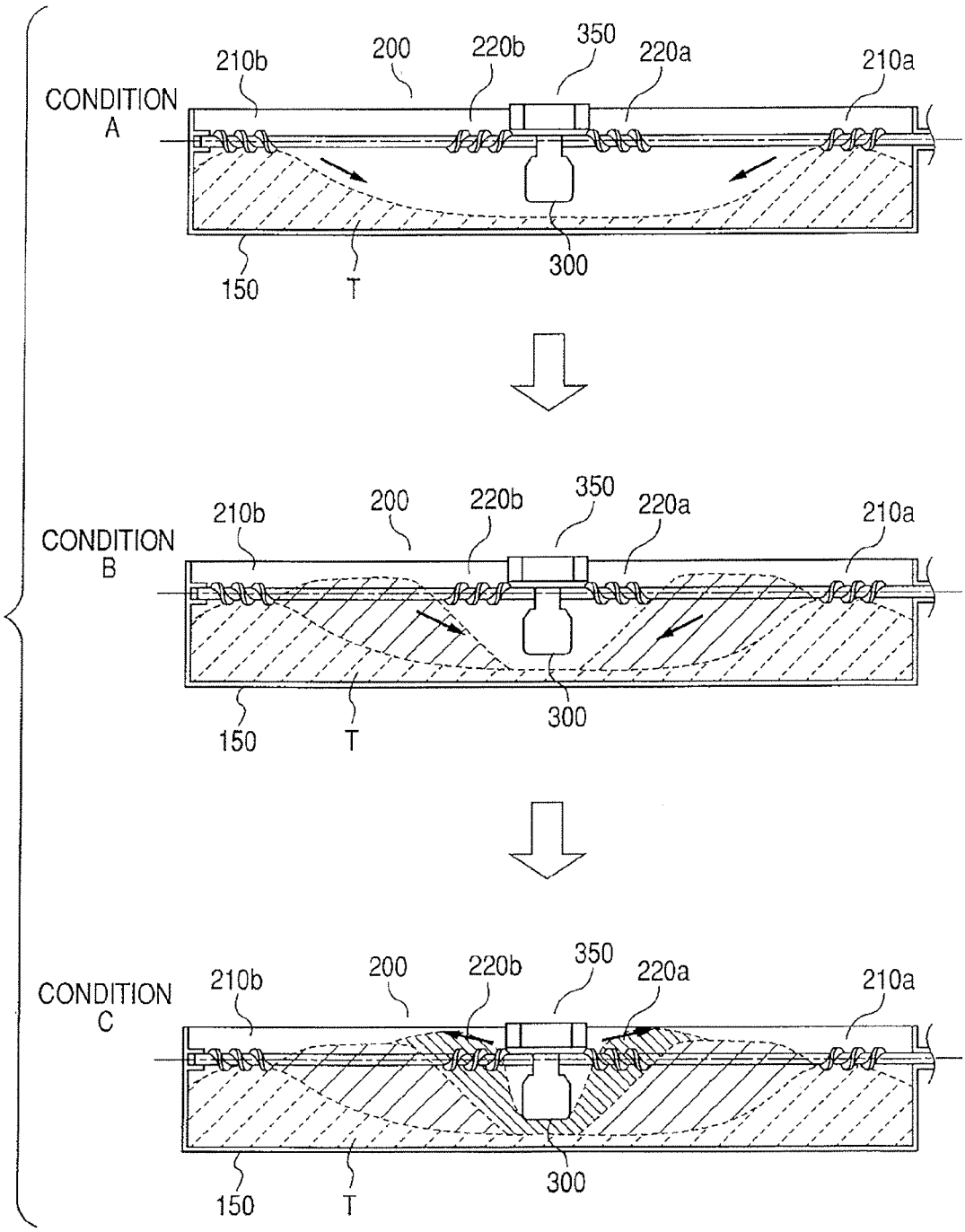
FIG. 7 is a sectional view illustrating each state in which residual toner is conveyed by the residual toner conveyance unit according to the embodiment 1 of the present invention.

FIG. 7 illustrates the change of the piled state of the residual toner when the frameless print process is performed with the configuration of the present embodiment.

When the frameless print process is performed, the residual toner T concentrates and piles on both ends in the residual toner container 150 much more than it piles on the central portion. As described above, the both end toner image 503 of a record member is transferred on the secondary transfer roller 101, and enters the residual toner container 150. When the frameless print mode is continued, the residual toner T piling on both end portions reaches the residual toner conveyance unit 200 arranged at the upper portion of the residual toner container 150 as indicated by the status A shown in FIG. 7. Since the residual toner conveyance unit 200 is rotating, the residual toner T piling on the drive gear side is conveyed by the first screw 210*a* toward the center. Similarly, the residual toner T piling on the opposite side of the drive gear is conveyed by the first screw 210*b* toward the center. Therefore, pressure is applied to the piled residual toner T in the longitudinal direction from both ends to the center, and the toner is pushed into the center, thereby piling the residual toner T toward the center as indicated by the status B shown in FIG. 7.

When the frameless print is continued, the residual toner T reaches the second screws 220*a* and 220*b* at the center in the longitudinal direction. After the residual toner T reaches them, the second screws 220*a* and 220*b* convey the toner from the center to both ends in the longitudinal direction. The first screw 210 and the second screw 220 are opposite in the convey direction, and since there is no screw between the first screw 210 and the second screw 220, the residual toner T is piled between the first screw 210 and the second screw 220. That is, the residual toner T piling around the residual toner detection device 350 can be suppressed, and the residual toner T piles as indicated by the status C shown in FIG. 7.

With the above-mentioned configuration, the residual toner detection device 350 can be prevented from getting dirty by the piled residual toner T until the residual toner container 150 becomes full of the residual toner T, and can be prevented from getting dirtier than the cleaning capability of the cleaning member 300. Therefore, the volume of the residual toner container 150 can be efficiently filled with the residual toner T, thereby improving the toner containing efficiency of the residual toner container 150, and correctly detecting the accumulation level of the toner in the residual toner container 150.

Embodiment 2 of the Present Invention

Figure 8:
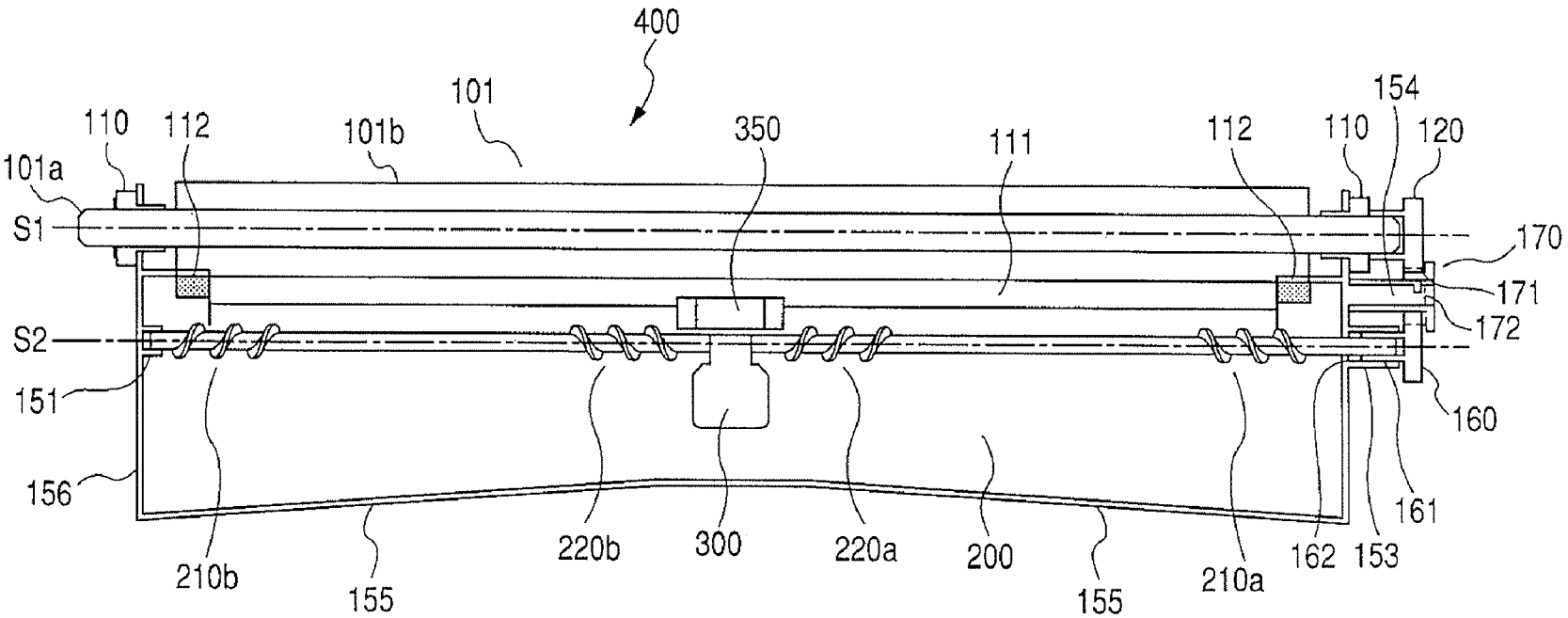
FIG. 8 is a sectional view illustrating the configuration of the cleaning device according to an embodiment 2 of the present invention.

The cleaning device according to the embodiment 2 of the present invention is described below by referring to FIG. 8.

Since a rough configuration of the entire image forming apparatus is similar to the configuration according to the above-mentioned embodiment, the members and parts having the same functions as in the above-mentioned embodiment 1 of the present invention are assigned the identical reference numerals, and the detailed descriptions are omitted here.

A cleaning device 400 according to the present mode has a residual toner container 156 whose bottom is tapered downward from the center to both ends in the axis direction of the secondary transfer roller 101. In FIG. 8, the residual toner container 156 has a slope portion 155 of the bottom of the residual toner container configured to be incorporated into the residual toner container 156, and the slope portion 155 is inclined downward from the portion near the residual toner detection device 350 toward both ends. Other configurations are identical to those of the cleaning device 100 according to the above-mentioned embodiment 1 of the present invention.

As in the above-mentioned embodiment 1 of the present invention, when the frameless print process is performed, the pile of the residual toner T concentrates on both end portions as compared with the pile of the residual toner T at the central portion. When the frameless print process is continued, the residual toner T piled on both end portions reaches the residual toner conveyance unit 200 arranged at the upper portion of the residual toner container 156. Since the residual toner conveyance unit 200 is rotation-driven, the residual toner T piled on the drive side is conveyed toward the center by the first screw 210*a*. Similarly, the residual toner T piled on the non-driven side is conveyed toward the center by the first screw 210*b*.

At this time, the effect of the slope portion 155 generates large convey resistance against the conveyance of the residual toner T from both end sides of the residual toner container 156 to the center. Therefore, the amount of residual toner T conveyed toward the central portion of the residual toner container 150 decreases. As a result, the residual toner T piled around the residual toner detection device 350 is suppressed. Thus, the erroneous detection by the residual toner detection device 350 can be furthermore suppressed, thereby more correctly detecting the accumulation level of the toner in the residual toner container 156, and improving the toner containing efficiency in the residual toner container 156.

Embodiment 3 of the Present Invention

Figure 9:
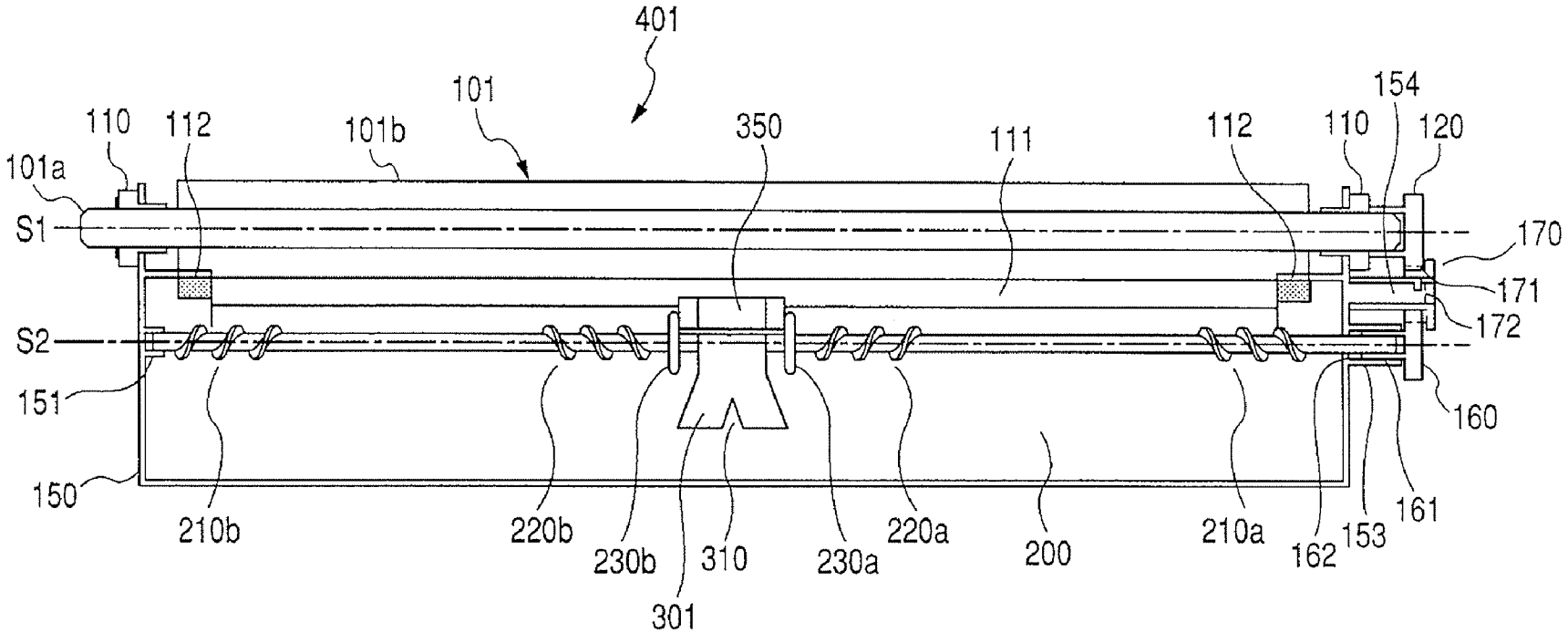
FIG. 9 is a sectional view illustrating the cleaning device according to an embodiment 3 of the present invention.

The cleaning device according to the embodiment 3 of the present invention is described below by referring to FIGS. 9 to 11. Since a rough configuration of the entire image forming apparatus is similar to the configuration according to the above-mentioned embodiment, the members and parts having the same functions as in the above-mentioned embodiment 1 of the present invention are assigned the identical reference numerals, and the detailed descriptions are omitted here. Described below is the configuration of the cleaning device according to the present embodiment.

A cleaning device 401 has a cleaning member 301 which is provided for the residual toner conveyance unit 200 whose rotation enables the member to contact the residual toner detection device 350 and intermittently clean the residual toner detection device 350.

Figure 11A:
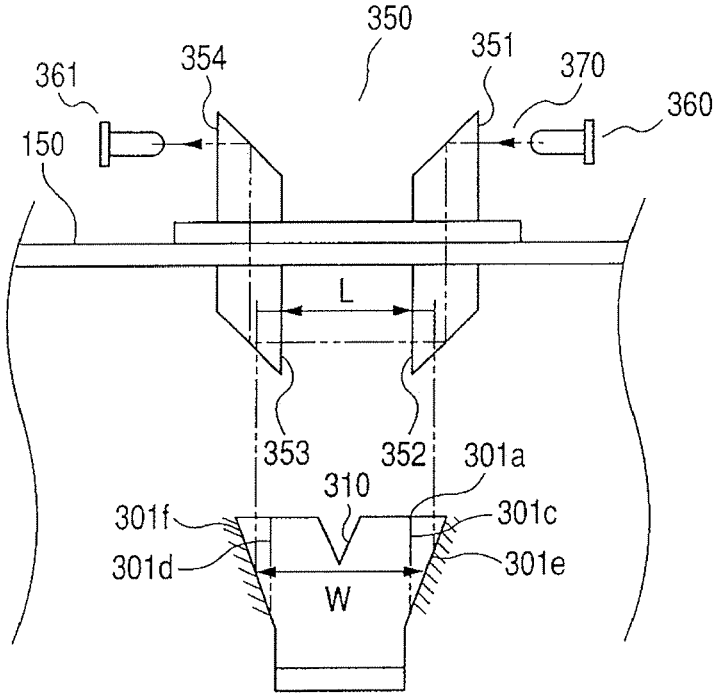
FIGS. 11A and 11B are partial sectional views illustrating the positional relationship between the residual toner detection device and the cleaning member according to the embodiment 3 of the present invention.

The cleaning member 301 is made of an elastic member such as urethane and the like. As shown in FIG. 11A, the cleaning member 301 is formed such that the width W in the direction (of the axis S2 shown in FIG. 9) parallel with the optical axis of the infrared light of the residual toner detection device 350 can be wider than the distance L between the two detection planes 352 and 353. That is, the width W of the portions 301*e* and 301*f* of the cleaning member 301 contacting the detection planes 352 and 353 is wider than the distance L between the two detection planes 352 and 353 (W>L). The width W of the cleaning member 301 is formed wide enough to be separated from the center (axis S2) of the rotation of the residual toner conveyance unit 200 in the space between the two detection planes 352 and 353.

The cleaning member 301 has a notch 310 inside at a free end portion 301*a* opposite the center of the rotation. The notch 310 is triangular, has a bottom side of 4.5 mm and a height of 3.8 mm, and has the bottom side at the free end portion 301*a*.

The cleaning member 301 is attached to the residual toner conveyance unit 200 with a cohesive agent such that the end portion opposite the free end portion 301*a* can be parallel with the central axis of the rotation of the residual toner conveyance unit 200. The cleaning member 301 is designed to have its free end portion 301*a* contacting and passing the two detection planes 352 and 353 in the concave portion of the residual toner detection device 350 when the cleaning member rotates around the rotation center axis. At this time, as shown in FIG. 11B, the cleaning member 301 is attached to the residual toner conveyance unit 200 such that the free end portion 301*a* of the cleaning member 301 can be separated from the concave bottom of the residual toner detection device 350, and the notch 310 can pass along the bottom surface with clearance.

The cleaning device 401 has guide members 230*a* and 230*b* that are provided for the residual toner conveyance unit 200, and touch the residual toner detection device 350 to determine the position of the cleaning member 301 relative to the residual toner detection device 350.

Figure 11B:
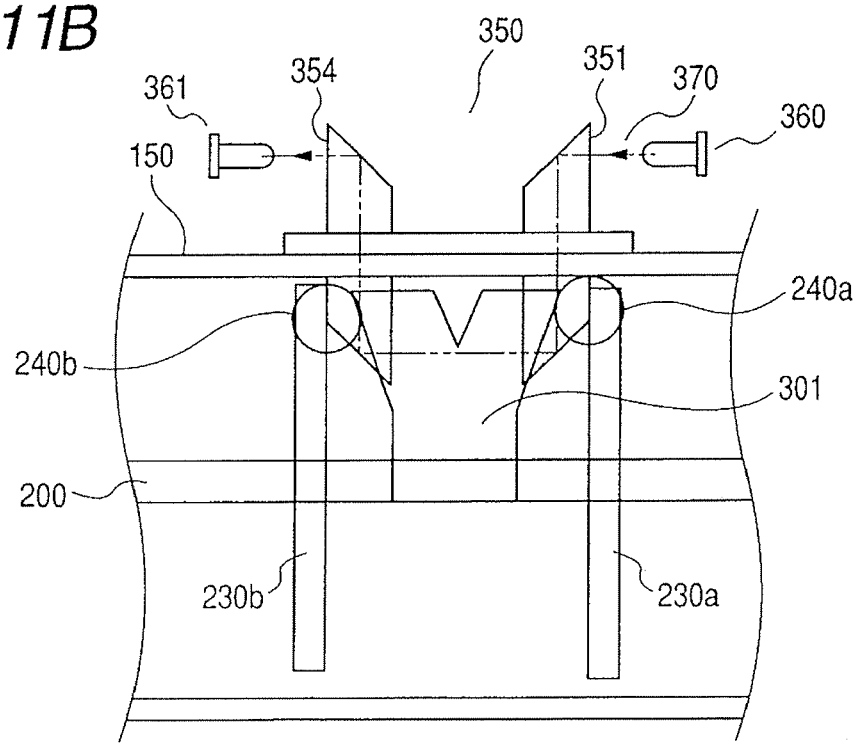
Figure 12:
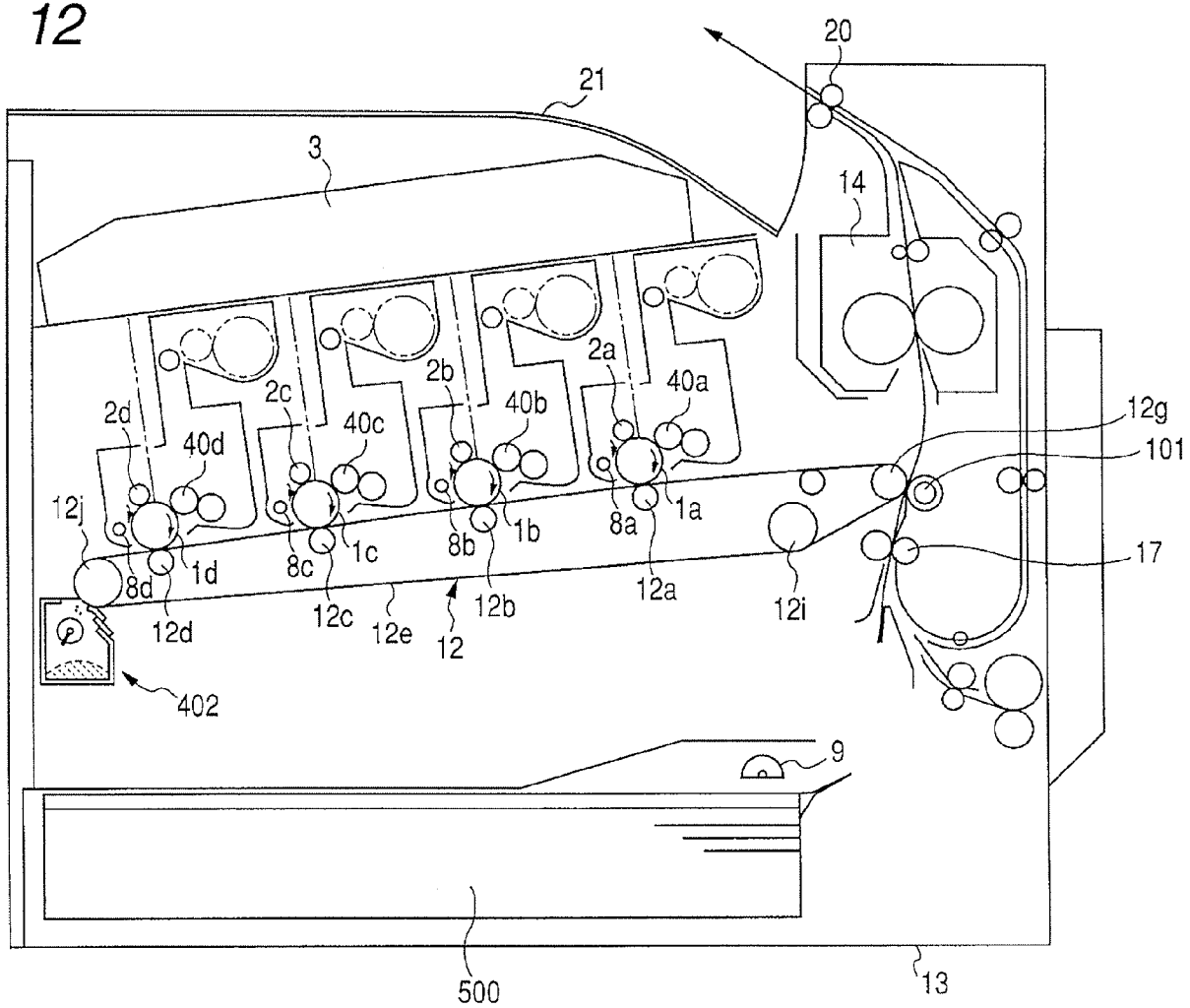
FIG. 12 is a schematic chart illustrating the rough configuration of the electronic photo image forming apparatus according to an embodiment 4 of the present invention.
Figure 13:
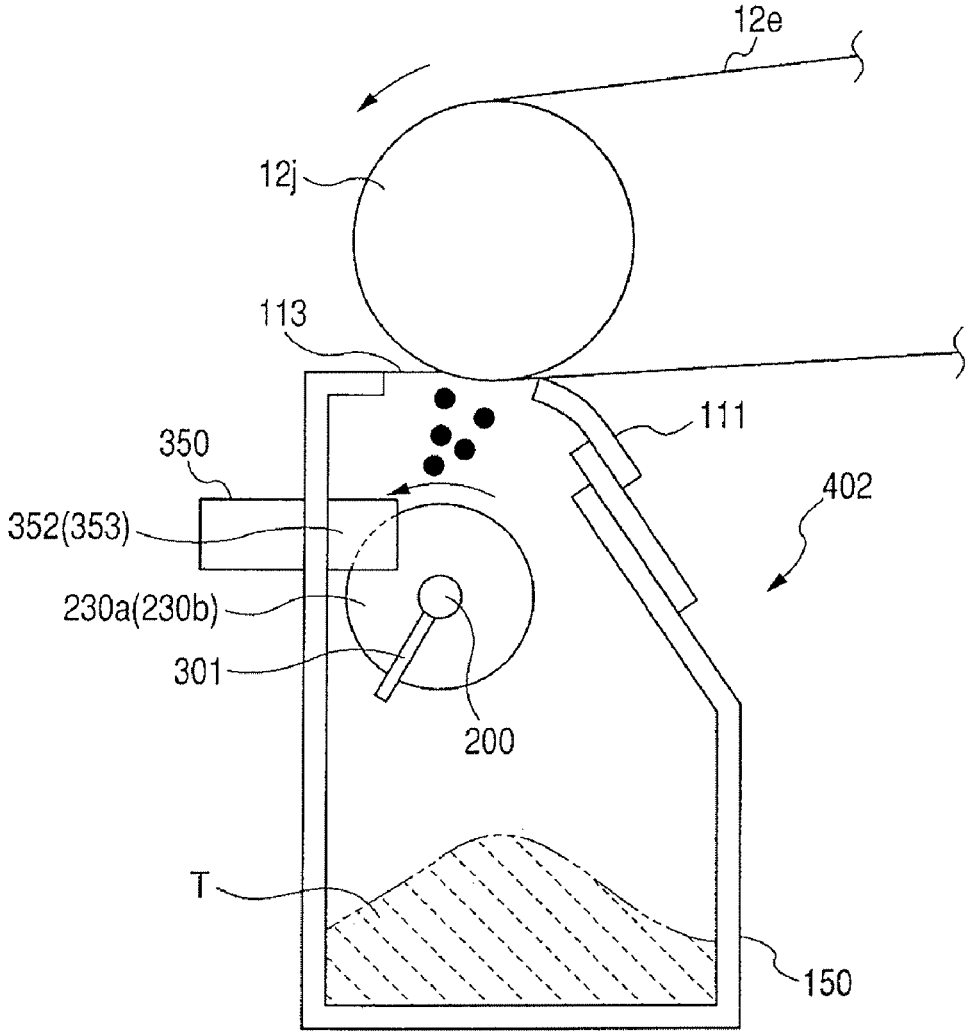
FIG. 13 is a sectional view illustrating the rough configuration of the cleaning device according to the embodiment 4 of the present invention.
Figure 14:
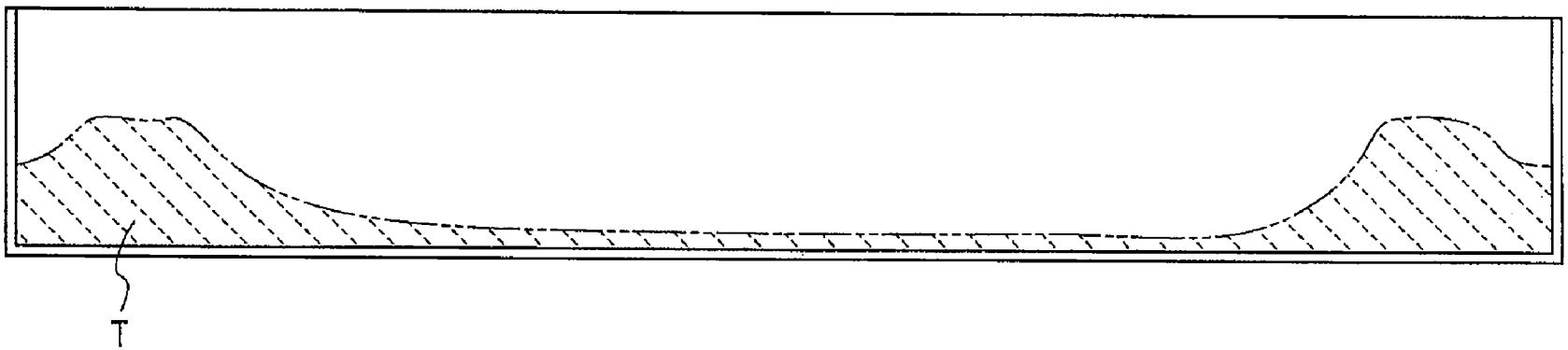
FIG. 14 PRIOR ART
FIG. 14 is a sectional view illustrating a pile of residual toner according to the related art.

Practically, as shown in FIG. 11B, the guide members 230*a* and 230*b* are mounted such that they hold the residual toner detection device 350 between them from both sides of the residual toner detection device 350 through the cleaning member 301 and the two detection planes 352 and 353 in the axis direction of the residual toner conveyance unit 200.

Figure 10:
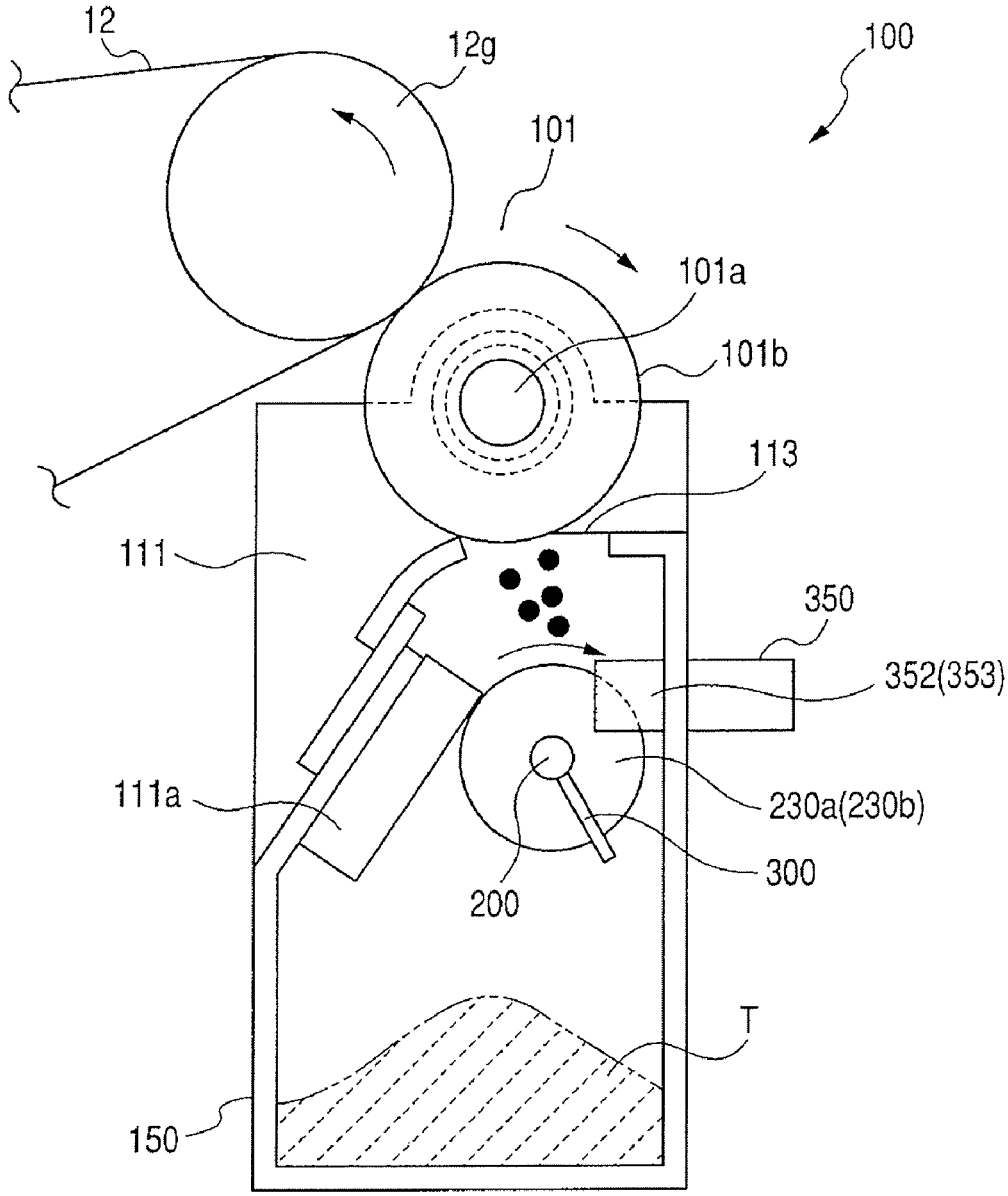
FIG. 10 is a primary sectional view illustrating the positional relationship between the residual toner detection device and the cleaning member according to the embodiment 3 of the present invention.

The guide members 230*a* and 230*b* have the form of a disk as shown in FIG. 10. The two disk surfaces hold the residual toner detection device 350 from both sides of the device at the center in the axis direction, and are attached to both side portions 240*a* and 240*b* of the residual toner detection device. The guide members 230*a* and 230*b* determine the position of the central line of the cleaning member 301 to be located at the same distances from the respective two detection planes 352 and 353 of the residual toner detection device 350. Thus, an idle operation of the cleaning member 301 on the detection planes 352 and 353 or insufficient cleaning by a partial contact by the discrepancy of the members between the two detection planes 352 and 353 and the cleaning member 301, and the variance in size of the members can be suppressed. Therefore, the cleaning member 301 can correctly contact and clean the detection planes 352 and 353. Even in the state in which the cleaning member 301 correctly contacts the detection planes 352 and 353 when the member passes the planes, the problem that different forces on the two detection planes 352 and 353 from different curves can generate uneven cleaning capabilities between the two detection planes 352 and 353 can be avoided. Therefore, the cleaning member 301 can contact the two detection planes 352 and 353 with substantially an identical force, thereby evenly cleaning the detection planes 352 and 353.

As shown in FIG. 10, the disk-shaped guide members 230*a* and 230*b* are designed to have their perimeters contact a metal plate (support member) 111*a* for attachment of the cleaning blade 111 to the residual toner container 150. Thus, the problem that the reaction received by the cleaning member 301 when it enters between the detection planes 352 and 353 causes the cleaning member 301 and the guide members 230*a* and 230*b* to be separated from the residual toner detection device 350 can be avoided, thereby correctly cleaning the two detection planes 352 and 353 by the cleaning member 301.

The central axis of the rotation of the residual toner conveyance unit 200 is parallel with the optical axis of the detected light (infrared light 370 shown in FIGS. 11A and 11B) passing through the two detection planes 352 and 353. It is also parallel with the conveyance direction of the residual toner conveyed in the residual toner container 150 by the guide members 230*a* and 230*b*. In addition, the guide members 230*a* and 230*b* are configured to hold the residual toner detection device 350 from both sides of the device, and arranged perpendicularly to reference to the conveyance direction of the residual toner. Thus, the guide members 230*a* and 230*b* suppress the residual toner T piled around the residual toner detection device 350 by the second screws 220*a* and 220*b* as second convey units for conveying toner from the center to both ends in the axis direction of the secondary transfer roller. They can also reduce the amount of residual toner entering the residual toner detection device 350, thereby preventing erroneous detection.

Thus, the guide members 230*a* and 230*b* constantly contact the residual toner detection device 350, and determine the position of the cleaning member 301 relative to the residual toner detection device 350. Therefore, when the residual toner conveyance unit 200 rotates, the cleaning member 301 attached to the residual toner conveyance unit 200 contacts and passes, in a curved state, the two detection planes 352 and 353 between the first plane of irradiation 352 and the second plane of incidence 353. In FIG. 7, dotted lines 301*c* and 301*d* written to the cleaning member 301 indicate the portions that contact the two detection planes 352 and 353 and are curved when they contact and pass the two detection planes 352 and 353. Thus, the residual toner T attached to the first plane of irradiation 352 and the second plane of incidence 353 is removed, and the decrease of the amount of received light by the photosensor 361 or the cutoff of the light by the scattering residual toner T can be prevented.

As described above, according to the present embodiment, as in the above-mentioned embodiments of the present invention, the toner containing efficiency of the residual toner container 150 can be improved, and the accumulation level of the toner in the residual toner container 150 can be correctly detected. Furthermore, since the position of the cleaning member 301 can be determined relative to the residual toner detection device 350 by the guide members 230*a* and 230*b*, the toner attached to the detection planes 352 and 353 in the container can be correctly removed by the cleaning member 301. Therefore, there is no erroneous detection, and the detection can be performed correctly and stably. Other embodiments are almost the same as those according to the above-mentioned embodiments of the present invention.

Embodiment 4 of the Present Invention

In the above-mentioned embodiments of the present invention, the secondary transfer roller is exemplified as a rotation member for removing toner. However, the present embodiment exemplifies a cleaning device 402 with almost the same configuration as the cleaning device 401 according to the embodiment 3 of the present invention as a cleaning device for removing the toner on the intermediate transferring belt 12*e*. The components having the same functions as the cleaning device 401 are assigned the identical reference numerals. The cleaning device 402 faces a driven roller 12*j* through the intermediate transferring belt 12*e*. In the present embodiment, a tension roller 12*i* applies tension to the intermediate transferring belt 12*e*.

As described above, when the frameless print process is performed, a toner image larger than a record member is formed on the intermediate transferring belt 12*e*. The toner for the portion larger than the record member is attached to the secondary transfer roller 101. However, all corresponding toner is not attached to the surface of the secondary transfer roller 101, but the toner not attached to the secondary transfer roller 101 remains on the intermediate transferring belt 12*e* as what is called residual toner after transfer. There is a larger amount of residual toner after transfer for the portion not corresponding to the record member than the amount corresponding to the record member because, with reference to the surface properties and the like, the record member and the secondary transfer roller 101 are different from each other, and the transfer condition is set such that the transfer efficiency on the record member can be higher. Thus, the amount of toner remaining on the intermediate transferring belt 12*e* after the second transfer tends to be larger on both sides in the longitudinal direction. Then, as the distribution of the collected toner of the cleaning device 402 for collecting the residual toner on the intermediate transferring belt 12*e*, a larger amount is detected on both sides in the longitudinal direction as in the cases of other cleaning devices 401 according to the other embodiments of the present invention. Therefore, as in the other embodiments of the present invention, the toner is moved in the longitudinal direction in the cleaning device 402, and the correctness of the detection of the amount of toner in the cleaning device 402 can be guaranteed.

Other Embodiments of the Present Invention

In the above-mentioned embodiments 1 to 3, the cleaning device is exemplified for cleaning the secondary transfer roller 101. However, a record member bearing belt can be cleaned to obtain a similar effect. That is, using a record member bearing member, an image forming apparatus can transfer a toner image by sequentially superposing each color of toner image on the record member borne by the record member.

The embodiment 4 of the present invention exemplifies the cleaning device 402 having the intermediate transferring belt 12*e*, but the same effect can be obtained by using a cleaning device having what is called a photosensitive drum as a cleaning device for a toner image bearing member. When a toner image is transferred from the photosensitive drum directly to the record member, it is especially effective.

In the above-mentioned embodiments of the present invention, a printer is exemplified as an image forming apparatus, but the influence is not limited to this application. For example, it can be an image forming apparatus of a copying machine, a facsimile device, etc., or other image forming apparatus for composite devices as combinations of plural functions. In addition, a record member bearing member can be used in an image forming apparatus to transfer a toner image by sequentially superposing a toner image of each color on the record member borne by the record member bearing member. By applying the present invention to the cleaning devices in these image forming apparatus, identical effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-044699, filed Feb. 22, 2006, which is hereby incorporated by reference herein in its entirety.

What is claimed is:

1. An image forming apparatus, comprising:

an image bearing member which bears a toner image, said image bearing member being movable in a moving direction;

a transfer member which transfers the toner image on the said image bearing member to a record member;

a cleaning member that cleans toner adhered onto said transfer member;

a toner container which contains toner cleaned by said cleaning member;

a conveyance member which conveys the toner contained in said toner container; and a toner sensor which detects toner at a detection position in said toner container, wherein the detection position is positioned at a center area of said toner container in a direction orthogonal to the moving direction of said image bearing member;

wherein the image forming apparatus is operable in a frameless print mode to form a toner image in a second area on said image bearing member and to transfer the toner image to edges of the record member, the second area including a whole of a first area corresponding to the record member on which the toner image is formed and being broader than the first area, wherein said conveyance member includes first screws to convey toner to a position corresponding to an area in which the first area is excluded from the second area in a direction toward the detection position, and second screws to convey toner to a position between said first screws and the detection position in a direction opposite to the direction toward the detection position, wherein said conveyance member includes a second cleaning member that cleans the toner at the detection position, and wherein said second cleaning member rotates according to a rotation of said conveyance member.

2. An image forming apparatus according to claim 1, wherein said toner sensor includes:

an illumination element that emits a detection light;

an illumination surface that illuminates the detection light;

a light-incoming surface into which the detection light illuminated from said illumination surface enters; and a light receiving element that receives a light incoming from said light-incoming surface, wherein said second cleaning member cleans said illumination surface and said light-incoming surface at the detection portion.

* * * * *